United States Patent [19]

Turner

[11] 4,248,045

[45] Feb. 3, 1981

[54] MEANS FOR SELECTIVELY TRANSMITTING DRIVE

[76] Inventor: David L. Turner, 5, Clarendon Crescent, Leamington Spa, Warwickshire, England

[21] Appl. No.: 26,965

[22] Filed: Apr. 4, 1979

[30] Foreign Application Priority Data

Apr. 4, 1978 [GB] United Kingdom ..... 13103/78

[51] Int. Cl.[3] ..... F15B 7/02

[52] U.S. Cl. ..... 60/537; 60/543; 60/565; 60/583; 60/594; 91/24; 92/60.5

[58] Field of Search ..... 60/537, 563, 564, 565, 60/577, 583, 594, 543; 91/24; 92/60.5

[56] References Cited

U.S. PATENT DOCUMENTS

| | | | |
|---|---|---|---|
| 2,423,677 | 7/1947 | Balogh | 92/60.5 |
| 3,010,283 | 11/1961 | Jansson | 60/577 |
| 3,250,335 | 5/1966 | Joelson | 60/537 |
| 3,653,211 | 4/1972 | Strebel | 60/583 |
| 3,863,681 | 2/1975 | Dostal | 60/537 |
| 3,972,652 | 8/1976 | Minnicino | 92/60.5 |
| 4,006,669 | 2/1977 | Price | 92/13.1 |
| 4,072,013 | 2/1978 | Barbareschi | 60/583 |
| 4,116,004 | 9/1978 | Geary | 60/594 |

*Primary Examiner*—Abraham Hershkovitz
*Attorney, Agent, or Firm*—Dowell & Dowell

[57] ABSTRACT

Drive is transmitted from a cam to a push rod via a body of liquid trapped between two pistons. A control element is normally urged against a seat by pressure in the body of liquid but can be lifted off its seat by the application of pressure to liquid in a control chamber. When the control element moves clear of its seat, liquid trapped between the pistons acts on a seat-engaging face of the control element and displaces the control element instead of driving the push rod.

6 Claims, 3 Drawing Figures

MEANS FOR SELECTIVELY TRANSMITTING DRIVE

BACKGROUND TO THE INVENTION

This invention relates to drive-transmitting means for transmitting drive selectively between a driving and a driven element. The driving element may be a cam or a crank and the driven element may be a reciprocating element.

The invention has been devised primarily for use in a reciprocating piston internal combustion engine to transmit drive selectively between a cam shaft and inlet and exhaust valves associated with the combustion chambers of the engine. During normal operation, each valve is required to execute a reciprocating motion which corresponds to the profile of an associated cam.

SUMMARY OF THE INVENTION

It is an object of the invention to provide drive-transmitting means which, when the power output required from the engine is only a part of the maximum power output, enables the normal transmission of motion from each cam to the associated valve to be discontinued so that the valve is not constrained to undergo motion corresponding to the profile of its cam.

According to the invention, there is provided a device comprising a body, an input element, an output element, a control element and means for conveying a signal to the control element wherein each of said elements is guided for movement relative to the body independently of the other elements, the elements collectively define, at least in part, a main chamber for containing liquid, there is provided a seat engageable by the control element and the control element is movable in response to said signal away from said seat to provide between the seat and the control element a gap which forms an extension of the main chamber whereby liquid displaced by movement of the input element can occupy said gap.

When liquid is permitted to enter the gap between the control element and its seat, the input element can move inwardly of the main chamber without a corresponding movement of the output element outwardly of the main chamber occurring.

The control element preferably has a surface which faces away from the seat and is exposed to the liquid in the main chamber, whereby the pressure in the liquid in the main chamber tends to maintain the control element in engagement with its seat.

BRIEF DESCRIPTION OF THE DRAWINGS

An example of drive-transmitting means embodying the invention will now be described with reference to the accompanying drawings wherein.

Figure 1:
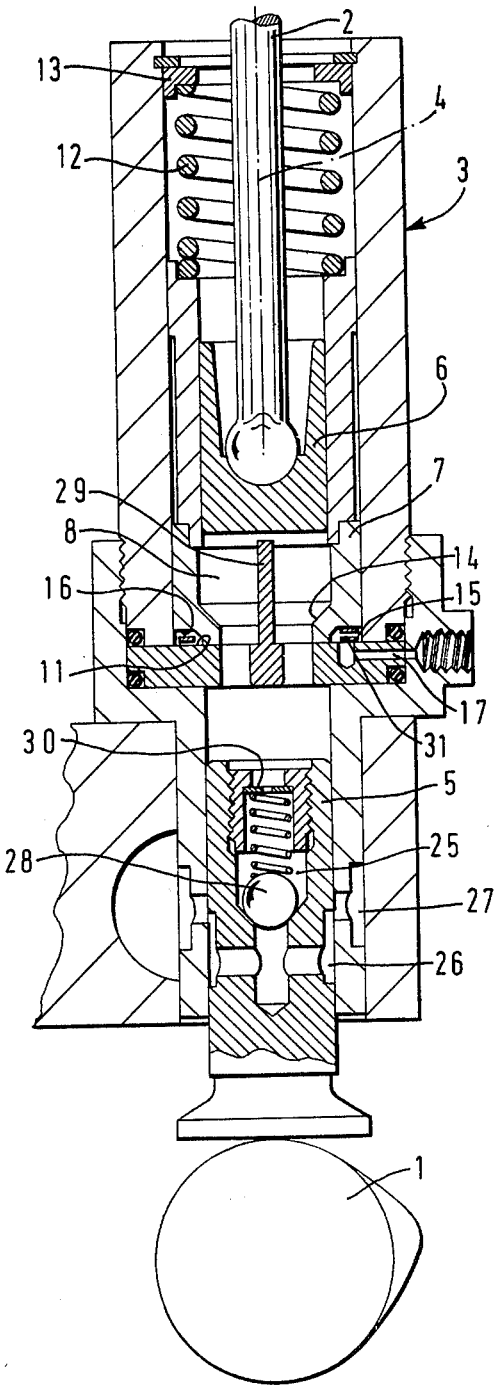
FIG. 1 shows a cross section of the drive transmitting means, together with parts of driving and driven elements associated therewith.
Figure 2:
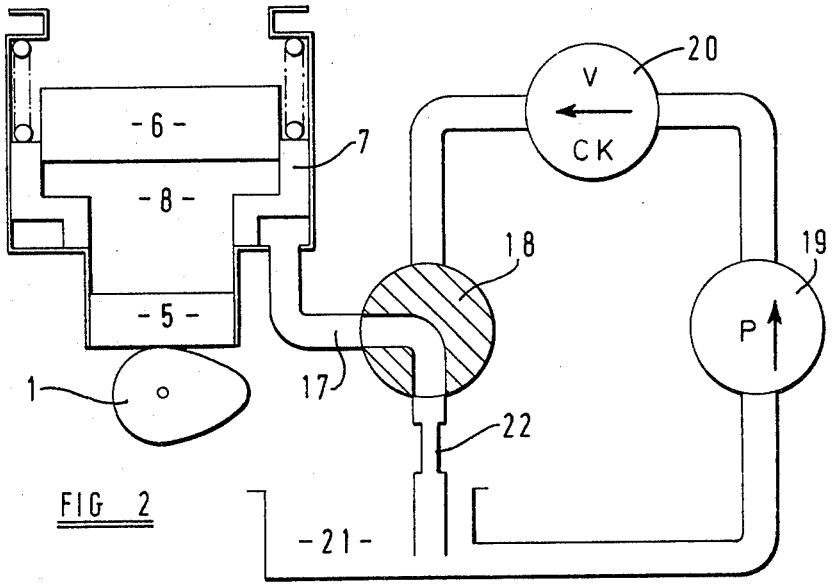
FIG. 2 shows diagrammatically the transmitting means and an associated hydraulic circuit during normal transmission of drive.

DETAILED DESCRIPTION.

The particular example of drive transmitting means shown in the accompanying drawings is arranged for transmitting drive selectively from a driving element in the form of cam 1 to a driven element in the form of a push rod 2. The push rod is associated with a valve (not shown) of an internal combustion engine for transmitting drive thereto. The drive transmitting means comprises a hollow body 3 which is fixed with respect to a cylinder block of the engine (not shown). In the body 3 there is mounted for sliding movement along an axis 4 an input element 5, an output element 6 and a control element 7. The input element is in the form of a piston and is a sliding fit in a bore of the body 3. The control element 7 is of annular form and is a sliding fit in a somewhat larger diameter bore of the body. The output element 6 is also in the form of a piston and is slidably received within the control element.

The body 3, input element 5 output element 6 and control element 7 collectively define a main chamber 8 which is full of oil when the device is in use. One end of the input element 5 engages the cam 1 and an opposite end face of the input element defines a lower boundary, as seen in FIG. 1, of the main chamber. An end of the output element 6 engages the push rod 2 and an opposite end face of the output element defines an upper boundary of the main chamber, as viewed in FIG. 1. An upper part of the lateral boundary of the main chamber is defined by the control element 7 and a lower part of the lateral boundary is defined by the body 3. As shown in FIG. 1, one end portion of the control element 7 lies outside the main chamber. The input, output and control elements can move along the axis 4 independently of one another and are guided for reciprocating movement by the body 3, indirectly in the case of the output element 6.

At the junction of the bores containing the input element and control element 7 respectively, there is formed on the body an annular shoulder 11 constituting a seat against which the control element 7 is urged by a spring 12. The spring is engaged between an end face of the control element remote from the seat 11 and an abutment 13 on the body 3. On the control element 7, there is formed an annular surface 14 which faces generally away from the seat 11 and is exposed to the liquid within the main chamber 8. Thus, any pressure established in the main chamber urges the control element against its seat.

The device shown in the drawings further includes means for conveying a signal to the control element 7. This means includes a control chamber 15 situated radially outwardly of that part of the control element which is engageable with the seat 11 and to which there is exposed an annular surface 16 on the control element which faces generally in the direction of movement of the control element towards the seat 11. Thus, any pressure established in the control chamber 15 urges the control element in a direction away from its seat 11.

The control chamber 15 is connected by a duct 17 with a solenoid operated valve 18. The valve 18 can be set to establish communication between the duct 17 and a pump 19 via a non-return valve 20 or, alternatively, between the duct 17 and a sump 21 via a fluid resistance 22. The sump 21 is connected to an input of the pump 19 and the pump is driven continuously by the engine to establish a positive pressure at the output of the pump.

During normal operation, the control element 7 is maintained in engagement with the seat 11 by the combined actions of oil in the main chamber 8 and the spring 12. When the input element 5 is driven upwardly by the cam 1, the oil is confined to the main chamber, the volume of which does not vary and a corresponding upward movement of the output element 6 occurs. The push rod 2 is urged downwardly by a valve spring (not shown) so that the output and input elements are caused to descend when permitted to do so by the cam 1. The valve 18 maintains communication between the duct 17 and the sump 21 so that the pressure in the control chamber 15 is substantially equal to the pressure in the sump, which is typically zero.

Figure 3:
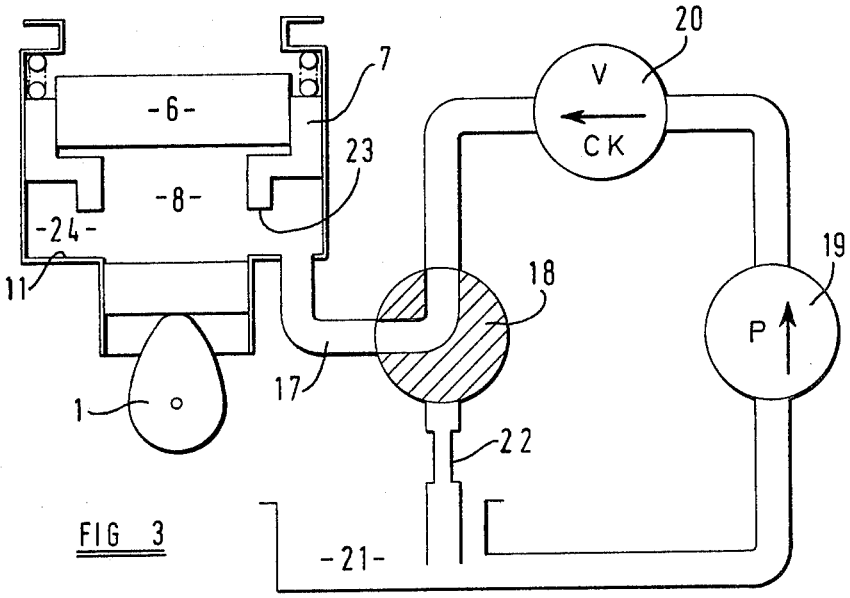
FIG. 3 shows diagrammatically the transmitting means and hydraulic circuit when transmission of drive is discontinued.

When transmission of drive from the cam 1 to the push rod 2 is required to be modified or discontinued, an electrical signal is fed to the solenoid operated valve 18 to set this valve in a condition in which the control chamber 15 is cut off from the sump and is maintained in communication with the output of the pump 19. Accordingly, the pressure developed at the output of the pump is applied to the surface 16 of the control element and urges the control element in a direction away from its seat 11. Provided that the input element 5 is not being urged upwardly by the cam 1, the pressure in the main chamber 8 is not sufficiently great to maintain the control element on its seat. The control element is lifted clear of its seat, thereby exposing to the liquid in the main chamber a seat-engaging surface 23 of the control element. However, the spring 12 prevents the control element from being moved far from its seat by pressure derived from the pump 19. When the input element 5 is next driven upwardly by the cam 1, the pressure in the main chamber 8 increases and the increased pressure acting on the surfaces 23 and 16 displaces the control element away from its seat, thereby establishing a gap 24 between the seat and the surface 23, as shown in FIG. 3. Oil displaced by upward movement of the input element enters the gap 24, which forms an extension of the main chamber, so that corresponding upward displacement of the output element 6 does not occur. When the cam permits the input element 5 to descend, the pressure in the main chamber 8, in the gap 24 and in the control chamber 15 falls to a value sufficiently low to permit the control element 7 to return towards its seat under the action of the spring 12.

It will be noted that, as the control element 7 moves into engagement with its seat 11, flow of oil between the main chamber 8 and the control chamber 15 is severely restricted and finally prevented while the volume of the main chamber is increased slightly. This would result in a drop in pressure in the main chamber, sufficient to enable the control element to be lifted off its seat once more by the pressure maintained in the control chamber 15. Accordingly, the control element does not sealingly engage the seat 11 while the control chamber 15 is in communication with the output of the pump 19.

In the input element 5 there is formed a passageway 25 leading from the main chamber 8 to a peripheral groove 26 also formed in the input element. This peripheral groove is permanently in communication with an oil way 27 formed in the body 3 and the passageway 25 contains a non-return valve 28 which permits oil to enter the main chamber 8 whenever the pressure therein falls below the pressure maintained in the oil way 27. Any oil which escapes from the main chamber 8 is replaced when the cam 1 next permits the input element to descend. Oil is supplied to the oil way 27 from an oil pump associated with the engine and which may be the pump 19.

A stop pin 29 is mounted in a part of the body 3 which spans the main chamber 8, the stop pin projecting upwardly to limit downward movement of the output element 6. This prevents an excessive amount of oil being expelled from the main chamber 8 during a period when the device is not in use. It will be understood that the valve spring associated with the push rod 2 will normally tend to maintain a positive pressure within the main chamber, even when the cam 1 is not being rotated.

If the control chamber 15 is in communication with the output of the pump 19, the control element 7 is well clear of its seat 11 and the valve 18 is then operated to establish communication between the control chamber 15 and the sump 21, there would be an excessive loss of oil from the main chamber 8 to the sump if flow of oil to the sump was not restricted by the resistance 22. This resistance is sufficiently small to ensure that the pressure in the control chamber cannot rise significantly above the pressure in the sump owing to leakage of oil from the main chamber to the control chamber whilst the control element is engaged with its seat.

A further fluid resistance is provided in the oil passageway 25 by an orifice plate 30. This plate restricts the flow of oil into the main chamber from the oilway 27 sufficiently to avoid there being maintained in the gap 24 and control chamber 15 a significant positive pressure when the control chamber is in communication with the sump.

The control element 7 functions as a valve. During normal operation, it is engaged with the seat 11 and prevents escape of oil from the main chamber 8. When normal transmission of drive is to be interrupted, the control element moves off its seat and permits oil to escape from the main chamber 7 into the gap 24. The greater the volume of oil displaced from the main chamber into the gap, the greater the separation of the control element from its seat and therefore the smaller the resistance to flow of oil into the gap. Since the gap extends completely around the main chamber the distance through which oil must flow to escape from the main chamber into the gap is small. The arragement provides very little resistance to flow of oil from the main chamber. Furthermore, once the control element has moved off its seat, the greater the pressure established in the main chamber 8 the more rapidly will the control element 7 move away from its seat.

In an alternative embodiment of the invention, the pump 19 and valve 20 are omitted. All other parts shown in the drawings are retained and the valve 18 is arranged in one condition to close the duct 17 and in the other condition to connect the duct with the sump. When the duct 17 is closed, leakage of oil between the seat 11 and the surface 23 causes the pressure in the control chamber 15 to rise to a value such that the control element is lifted off its seat. The control element re-engages its seat only when the control valve is operated to re-establish communication between the control chamber and the sump.

It is envisaged that, in an internal combustion engine comprising a plurality of cylinders, each having a plurality of valves, drive transmitting means as shown in the drawings may be associated with some only of the valves, known arrangements of tappets and/or push rods being provided to transmit drive from a cam shaft to other combustion chamber valves of the engine.

The action of the spring 12 on the control element 7 may be modified by the provision of a further spring 31 arranged to act on the control element in opposition to the spring 12. As shown in FIG. 1, when the spring 31 is provided, it is conveniently situated in the control chamber 15. The spring 31 has a relatively short stroke as compared with that of the spring 12.

The spring 31 reduces the pressure which it is necessary to establish in the control chamber in order to move the control element 7 off its seat 11. The spring 31 becomes fully extended when the control element has moved a short distance from it.

It is preferred that the spring 12 should exert on the control element 7 a relatively large force throughout the range of movement of the control element. This ensures that the control element follows the movement of the input element 5 and avoids the establishment in the chamber 8 of a low pressure whilst the control element is well spaced from its seat 11. If the pressure in the main chamber is allowed to fall unduly, additional oil will enter from the oil way 27 and the control element will have insufficient travel to avoid movement of the output element 6. The spring 31 assists the fluid pressure in the control chamber 15 to overcome the strong action of the spring 12 and raise the control element from its seat, thereby allowing the pressure in the main chamber 8 to act on the surfaces 16 and 23 of the control element. This allows a pump with a lower output pressure than would otherwise be the case to be selected for the pump 19. If the pump is driven by the engine, the output pressure of the pump may be low when the engine is running at low speed.

I claim:

1. A device for transmitting drive selectively and comprising a body, an input element, an output element, a control element and means for conveying a signal to the control element, wherein each of said elements is guided for movement relative to the body independently of the other elements, the elements collectively define, at least in part, a main chamber for containing liquid, there is provided a seat engageable by the control element and the control element is movable in response to said signal away from said seat to provide between the seat and the control element a gap which forms an extension of the main chamber and remains in communication with the main chamber throughout movement of the input element for accommodating liquid displaced by movement of the input element, the control element has a first surface which is engageable with the seat and a second surface which faces away from the seat and is exposed to the liquid in the main chamber, whereby the pressure in said liquid in the main chamber acts on the second surface for urging the control element unto the seat when said first surface is engaged with the seat, a portion of the control element is disposed outside the main chamber and the control element can be moved further from the seat by the application to the control element via said gap of pressure established in the main chamber, whereby upon application of said signal to the control element, the input element can move inwardly of the main chamber without causing displacement of the output element outwardly of the main chamber.

2. A device according to claim 1 wherein the seat is formed on the body.

3. A device according to claim 1 or claim 2 wherein the control element has a third surface which faces in the same general direction as does the first surface and said means for conveying a signal comprises a duct through which fluid pressure can be applied to the third surface for urging the control element away from its seat.

4. A device according to claim 1 wherein all of said elements are guided by the body for reciprocation along respective paths which are rectilinear and parallel to each other.

5. A device according to claim 1 wherein one of said elements is annular and contains another of the elements.

6. A device according to claim 1 further comprising a spring arranged for urging the control element towards the seat.

* * * * *